US010259691B1

(12) United States Patent
Hong

(10) Patent No.: US 10,259,691 B1
(45) Date of Patent: Apr. 16, 2019

(54) HOIST RING WITH ENGAGEABLE RETAINER

(71) Applicant: YOKE INDUSTRIAL CORP., Taichung (TW)

(72) Inventor: Rong-Der Hong, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 0 days.

(21) Appl. No.: 15/858,698

(22) Filed: Dec. 29, 2017

(51) Int. Cl.
*B66C 1/66* (2006.01)

(52) U.S. Cl.
CPC ..... *B66C 1/66* (2013.01)

(58) Field of Classification Search
CPC ..... B66C 1/66
USPC ..... 294/215; 411/400, 402, 403, 401; 403/78, 164
See application file for complete search history.

(56) References Cited

U.S. PATENT DOCUMENTS 3,895,836 A * 7/1975 Barnes ..... B66C 1/64 24/600.8
4,330,990 A * 5/1982 Schreyer ..... F16G 17/00 294/82.17
4,429,526 A * 2/1984 Rehbein ..... F16G 15/06 59/93
5,472,254 A * 12/1995 Wander ..... B66C 1/66 294/82.35
5,690,457 A 11/1997 Smetz
9,664,224 B2 * 5/2017 Ivanic ..... B60P 7/0807
D803,668 S * 11/2017 Bradshaw ..... D8/367
2010/0207406 A1 * 8/2010 Thomeczek ..... B66C 1/66 294/215

OTHER PUBLICATIONS

Examination report for TW106138426, dated Jan. 17, 2018, Total of 3 pages.
Search report for TW106138426, dated Jan. 16, 2018, Total of 1 page.

* cited by examiner

*Primary Examiner* — Paul T Chin
(74) *Attorney, Agent, or Firm* — Lynette Wylie; Apex Juris, Pllc.

(57) ABSTRACT

A hoist ring includes a ring having a base portion and a ring portion connected to the base portion, a bolt, a retainer having a second locking portion and two arms, and a spring. The bolt coupled to the base portion has a head and a body connected to the head. The head has a first locking portion. The body is adapted to fix the ring to an object. The second locking portion is connected to the arms, and is adapted to be engaged with the first locking portion. The arms are spaced from each other by a distance, and are adapted to extend to two lateral sides of the ring portion. The arms are each respectively provided with an abutting surface. Two ends of the spring respectively fit around the arms. An inner edge of the ends of the spring respectively abuts against two abutting surfaces of the arms.

9 Claims, 6 Drawing Sheets

HOIST RING WITH ENGAGEABLE RETAINER

BACKGROUND OF THE INVENTION

1. Technical Field

The present invention relates generally to a bolt structure, and more particularly to a hoist ring.

2. Description of Related Art

Hoist rings have been widely used in industry. Typically, a conventional hoist ring includes a ring and a bolt, wherein the bolt usually passes through the ring to be rotatably disposed, and is adapted to be fixed on an object. The ring is adapted to be connected by hooks or tools such as hoists, cranes, jacks, etc., whereby to lift heavy objects via the hoist ring.

In order to allow the ring of the hoist ring to rotate relative to the bolt and not rotate relative to the bolt, a fastener is disposed to be connected between the ring and the bolt. In this way, the ring could not rotate relative to the bolt when the fastener is connected to the bolt and the ring. However, the fastener is easily disengaged from the ring and easily lost while in use, which is inconvenient. In all aspects, the conventional hoist ring still has room for improvements.

BRIEF SUMMARY OF THE INVENTION

In view of the above, the primary objective of the present invention is to provide a hoist ring, and a retainer thereof would not easily disengage therefrom.

The present invention provides a hoist ring, including a ring, a bolt, a retainer, and a spring. The ring has a base portion and a ring portion, which are connected to each other. The bolt is coupled to the base portion of the ring, wherein the bolt has a head and a body, which are connected to each other. The head has a first locking portion; the body is adapted to fix the ring to an object. The retainer has a second locking portion and two arms, wherein the second locking portion is connected to the two arms, and is adapted to be engaged with the first locking portion. The two arms are spaced from each other by a distance, and are adapted to extend to two lateral sides of the ring portion; the two arms are each respectively provided with an abutting surface. Two ends of the spring respectively fit around the two arms. An inner edge of each of the two ends of the spring respectively abuts against each of the abutting surfaces of the two arms.

With the aforementioned design, the abutting surface of the retainer could firmly position the spring. In this way, the spring could be prevented from being disengaged from the retainer, and therefore, the retainer could be prevented from being disengaged from the ring.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
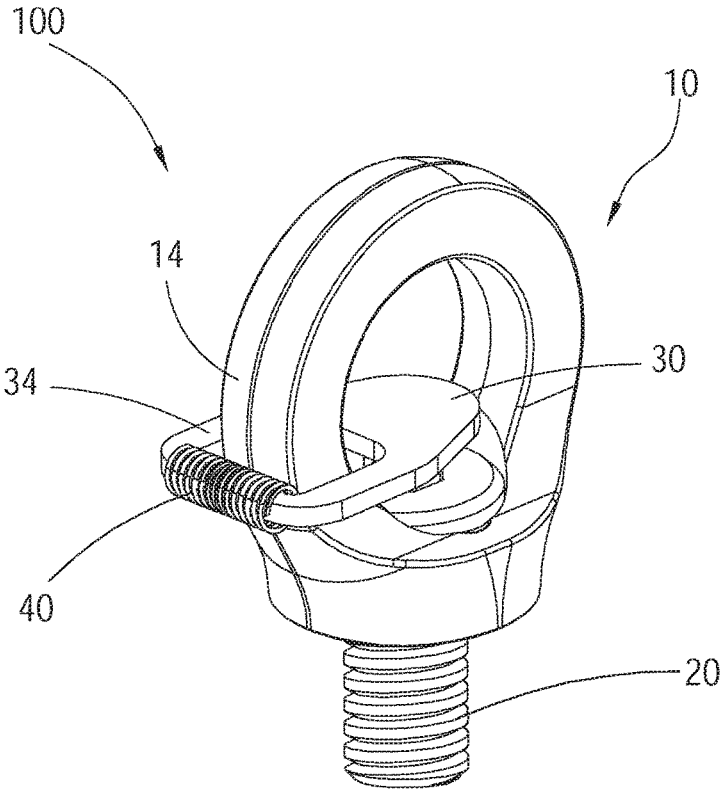
FIG. 1 is a perspective view of the hoist ring of a first embodiment of the present invention.
Figure 2:
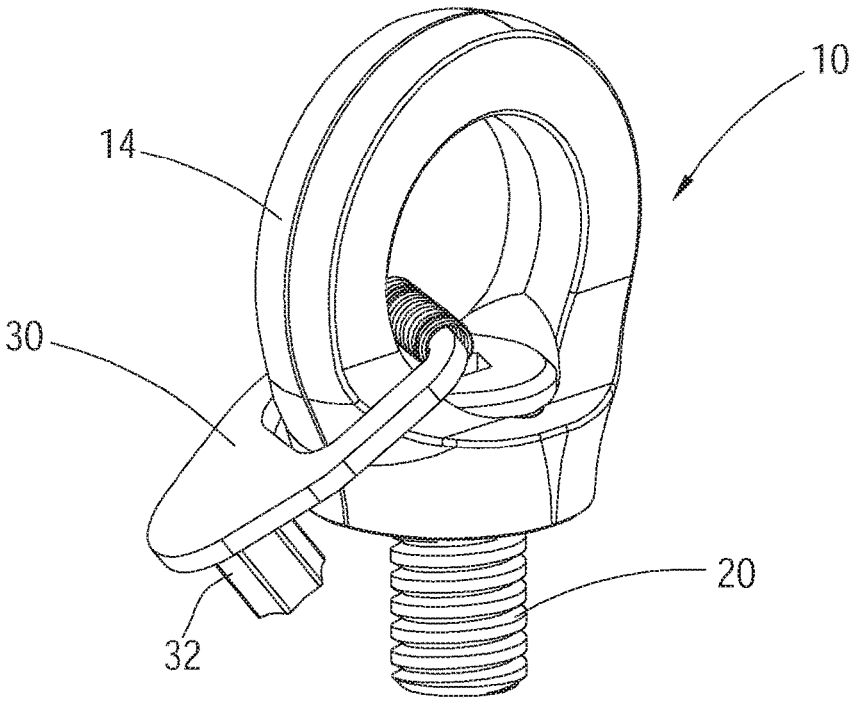
FIG. 2 is a perspective view of the hoist ring of the first embodiment, showing the retainer and the spring hang on the ring.
Figure 3:
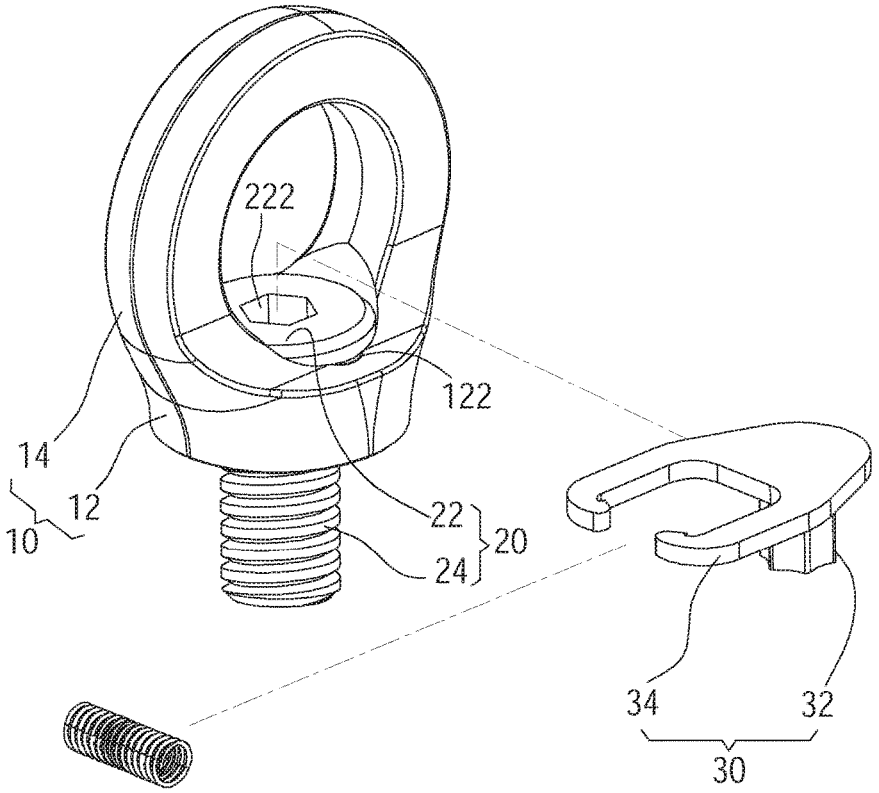
FIG. 3 is an exploded view of the hoist ring of the first embodiment.

A hoist ring 100 of a first embodiment of the present invention is illustrated in FIG. 1 to FIG. 3, wherein the hoist ring 100 includes a ring 10, a bolt 20, a retainer 30, and a spring 40.

The ring 10 has a base portion 12 and a ring portion 14, which are connected to each other. The base portion 12 has a perforation 122, which is adapted to be passed through by the bolt 20. The ring portion 14 is located above the base portion 12, and adapted to be engaged with a hook, a sling, or a chain sling, etc. which passes through a space enclosed by the ring portion 14.

The bolt 20 is adapted to fix the ring 10 to an object (not shown), and has a head 22 and a body 24, which are connected to each other. In a top of the head 22 is provided with a first locking portion 222. The body 24 is adapted to be secured to the object. In the current embodiment, the first locking portion 222 is a hexagonal recess as an example which is recessed into the head 22. The body 24 has thread thereon, which is adapted to be screwed into the object or to be indirectly connected to the object.

Figure 4:
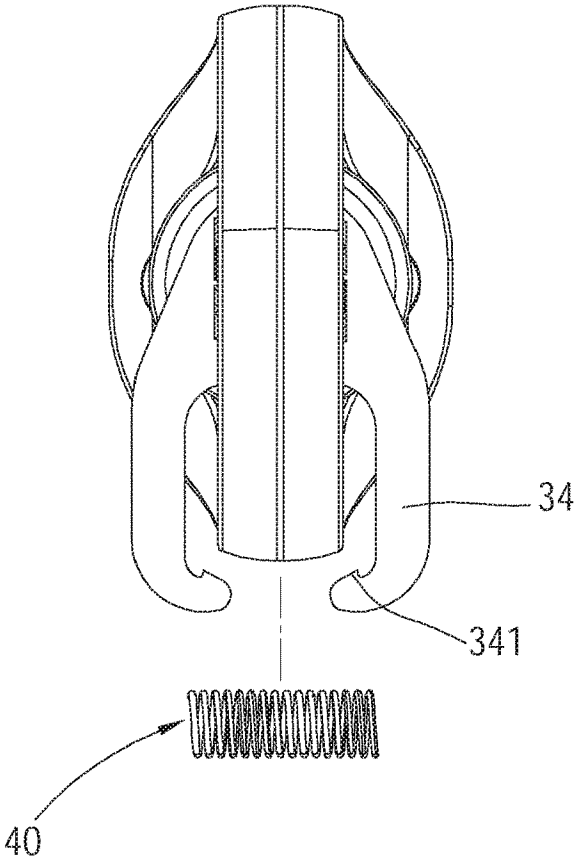
FIG. 4 and FIG. 5 are top views of the of the hoist ring of the first embodiment, showing the spring is engaged with the retainer.
Figure 5:
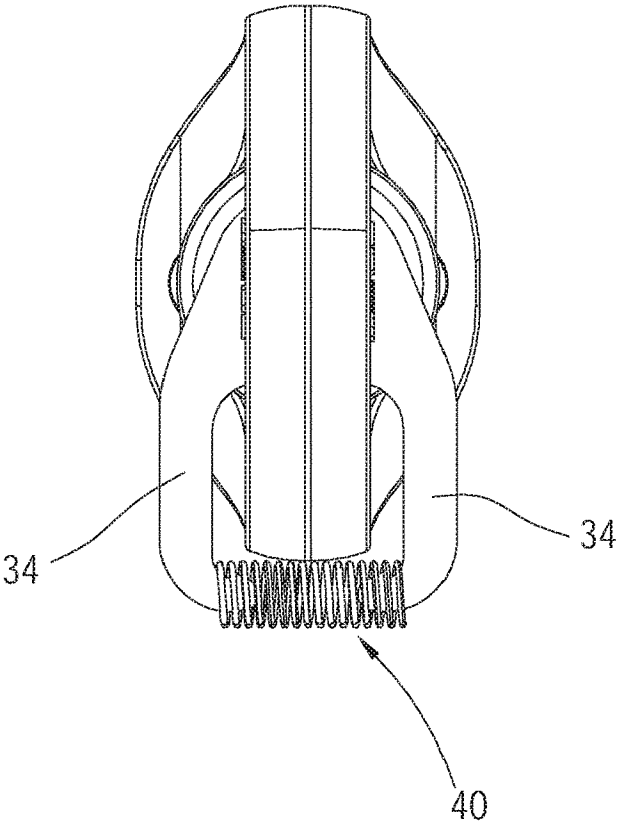
Figure 6:
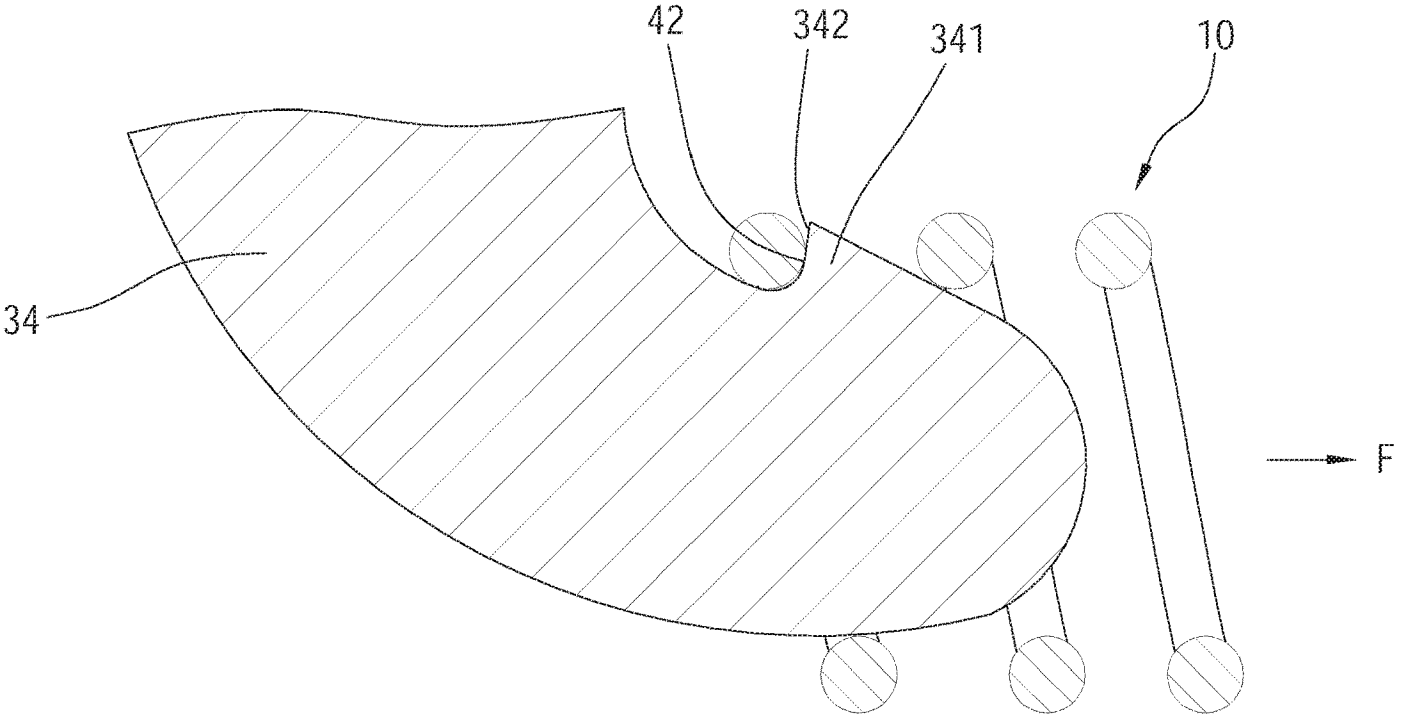
FIG. 6 is a partial sectional enlarged view of the of the hoist ring of the first embodiment, showing the engagement between the spring and the retainer.

As shown in FIG. 3 and FIG. 4, the retainer 30 has a second locking portion 32 and two arms 34, wherein the second locking portion 32 is connected to the two arms 34. The second locking portion 32 matches with the first locking portion 222, and is detachably engaged with the first locking portion 222. Two arms are spaced from each other by a distance, and are adapted to extend to two lateral sides of the ring portion 14. Each of the two arms is respectively provided with an abutting surface 342 as shown in FIG. 6. In the current embodiment, the second locking portion 32 and the two arms 34 are integrally formed as a monolithic unit. The second locking portion 32 is a hexagonal post which matches with the hexagonal recess. Two terminal ends of the two arms 34 are inwardly bent to be close to each other, and between the bending portions and the terminal ends of the arms, two protruding portions 341 are respectively formed thereon. The two protruding portions 341 both protrude in a direction toward the second locking portion 32, and respectively have one of the abutting surfaces 342, wherein the two abutting surfaces 342 are disposed opposite to each other.

As shown in FIG. 3 to FIG. 6, the spring 40 is a compression spring as an example. Two ends of the spring 40 are adapted to be respectively fitted around the two arms 34. An inner edge 42 of each of the two ends of the spring 40 respectively abuts against each of the abutting surfaces 342 of the protruding portions 341 of the two arms 34. When the spring 40 joins and fits around the two arms 34, the spring 40 and the two arms 34 define a closed ring which surrounds a periphery of part of the ring portion 14.

With the retainer 30, as shown in FIG. 1, when the second locking portion 32 of the retainer 30 is engaged with the first locking portion 222 of the bolt 10, the retainer 30 and the bolt 20 could move synchronously. Meanwhile, the two arms 34 are respectively located on two lateral sides of part of the ring portion 14. The ring portion 14 would abut against one of the two arms 34 of the retainer 30 when the ring portion 14 is rotated clockwise or counterclockwise. Since the bolt 20 is fixed and the retainer 30 only could move together with the bolt 20, a movement of the ring portion 14 would be restricted by the retainer 30, so that the ring portion 14 could not be driven to rotate. In this way, the ring 10 could not rotate relative to the bolt 20. In other words, a rotation angle of the ring 10 could be restricted.

In addition, when a user intends to allow the ring 10 to rotate relative to the bolt 20 or not to restrict the rotation angle of the ring 10, the second locking portion 32 of the retainer 30 can be disengaged from the first locking portion 222 of the bolt 10, as shown in FIG. 2, the retainer 30 could be hung on the ring portion 14 of the ring 10. It is worth mentioning that, with the combination of the spring 40 and the retainer 30, the retainer 30 could be hung on the ring portion 14 without being fallen off easily or being lost. Moreover, the abutting surfaces 342 on the protruding portions 341 of the retainer 30 could allow the spring 40 to be firmly hooked on the protruding portions 341. More specifically, the inner edge of the spring 40 could firmly abut against the abutting surfaces 342, so that the spring 40 could not be easily disengaged from the arms of the retainer 30 by an external force. For instance, as shown in FIG. 6, when the spring 40 is pulled by a force F, the inner edge 42 of the spring 40 could abut against the abutting surface 342, whereby the spring 40 would not be easily disengaged from the arms 34, providing a positioning performance.

Figure 7:
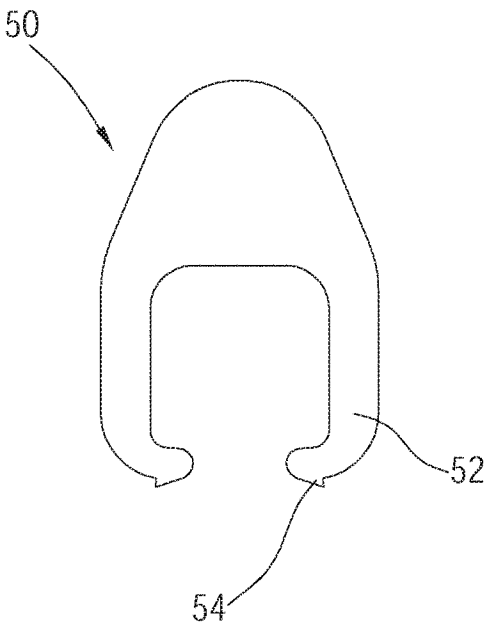
FIG. 7 is a top view of the hoist ring of a second embodiment of the present invention.

A top view of a retainer 50 of a hoist ring of a second embodiment of the present invention is illustrated in FIG. 7, which has almost the same structure as the retainer 30 of the aforementioned embodiment, except that each of protruding portions 54 of the two arms 52 of the retainer 50 protrudes in a direction away from the second locking portion of the retainer 50. Each of the protruding portions 54 has at least one abutting surface.

It is worth mentioning that, the protruding portions are not limited to protrude in the same direction. In an embodiment, the two protruding portions respectively protrude in different directions. For instance, one of the protruding portions protrudes in a direction toward the second locking portion of the retainer, and the other one of the protruding portions protrudes in a direction away from the second locking portion. Moreover, the protruding direction of the protruding portions is not limited by the aforementioned design, such as being protruded inward in the first embodiment or being protruded outward in the second embodiment. In other embodiments, the protruding portions could protrude upward or downward.

Figure 8:
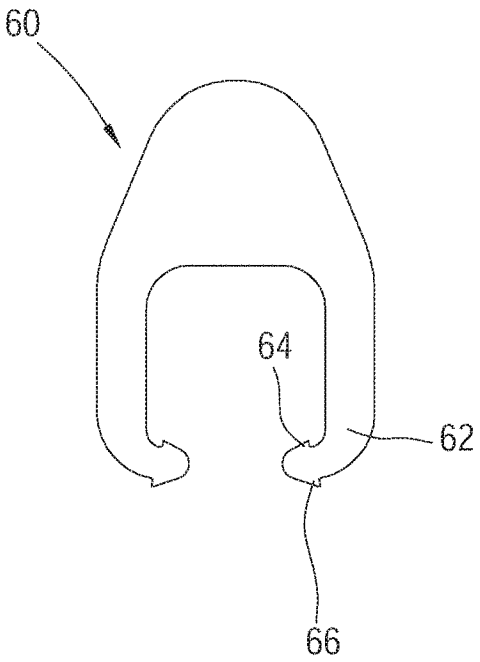
FIG. 8 is a top view of the hoist ring of a third embodiment of the present invention.

A top view of a retainer 60 of a hoist ring of a third embodiment of the present invention is illustrated in FIG. 8, which has almost the same structure as that of the aforementioned embodiments, except that two arms 62 of the retainer 60 respectively have two protruding portions 64, 66, wherein the two protruding portions 64, 66 respectively protrude in different directions. For instance, one of the protruding portions 64 protrudes inward, and the other one of the protruding portions 66 protrudes outward. Each of the two protruding portions 64, 66 has an abutting surface.

However, the formation of the protruding portions is not limited by the aforementioned design. In other embodiments, the protruding portions could be an annular shape, which is protruded from an outer peripheral surface of the arms.

Figure 9:
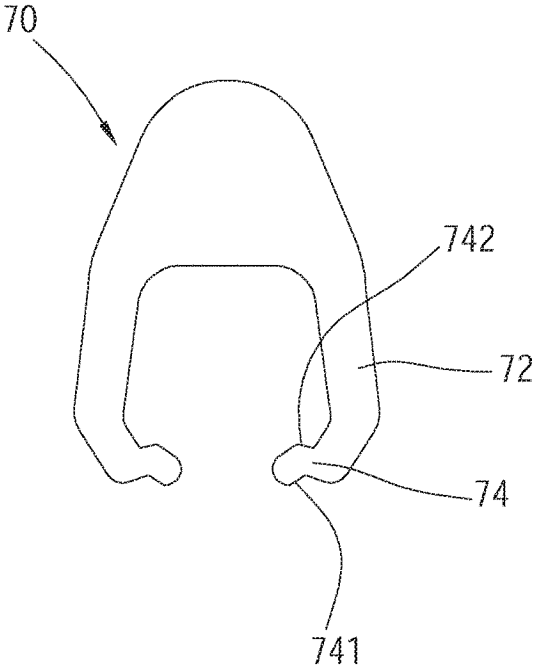
FIG. 9 is a top view of the hoist ring of a fourth embodiment of the present invention.

A top view of a retainer 70 of a hoist ring of a fourth embodiment of the present invention is illustrated in FIG. 9, wherein each of two arms 72 of the retainer 70 has a slip-out preventive portion 74, wherein the slip-out preventive portion 74 are extended portions bending from the two arms 72, respectively. Each of the slip-out preventive portion 74 has at least one abutting surface. In the current embodiment, each of the slip-out preventive portion 74 has two abutting surfaces 741, 742.

It is worth mentioning that, the protruding portions on the two arms are not limited to be symmetrically formed. In an embodiment, the protruding portions of one of the arms could be the protruding portions of the first embodiment, and the protruding portions of the other one of the arms could be the protruding portions of another embodiment (such as the second embodiment).

It must be pointed out that the embodiments described above are only some preferred embodiments of the present invention. All equivalent structures which employ the concepts disclosed in this specification and the appended claims should fall within the scope of the present invention.

What is claimed is:

1. A hoist ring, comprising:

a ring having a base portion and a ring portion, which are connected to each other;

a bolt coupled to the base portion of the ring, wherein the bolt has a head and a body, which are connected to each other; the head has a first locking portion; the body is adapted to fix the ring to an object;

a retainer having a second locking portion and two arms, wherein the second locking portion is connected to the two arms, and is adapted to be engaged with the first locking portion; the two arms are spaced from each other by a distance, and are adapted to extend to two lateral sides of the ring portion; the two arms are each respectively provided with an abutting surface; and a spring, wherein two ends of the spring respectively fit around the two arms; an inner edge of each of the two ends of the spring respectively abuts against each of the abutting surfaces of the two arms.

2. The hoist ring of claim 1, wherein two terminal ends of the two arms are inwardly bent to form a bending portion, and close to each other; the two abutting surfaces are respectively located between the bending section and the terminal end of each of the two arms.

3. The hoist ring of claim 1, wherein each of the two arms has a protruding portion formed thereon; the protruding portions have the abutting surfaces.

4. The hoist ring of claim 3, wherein the abutting surface of one of the arms is opposite to the abutting surface of the other one of the arms.

5. The hoist ring of claim 3, wherein the protruding portion of at least one of the arms protrudes in a direction toward the second locking portion.

6. The hoist ring of claim 3, wherein the protruding portion of at least one of the arms protrudes in a direction away from the second locking portion.

7. The hoist ring of claim 1, wherein each of the two arms has two protruding portions formed thereon; the two protruding portions of each of the two arms protrude in different directions, and respectively have one of the abutting surfaces.

8. The hoist ring of claim 7, wherein one of the two protruding portions of at least one of the arms protrudes in a direction toward the second locking portion, and the other one of the two protruding portions thereof protrudes in a direction away from the second locking portion.

9. The hoist ring of claim 1, wherein at least one of the arms has a slip-out preventive portion; the slip-out preventive portion has the abutting surfaces.

* * * * *